US010907836B2

(12) United States Patent
Vasan

(10) Patent No.: US 10,907,836 B2
(45) Date of Patent: Feb. 2, 2021

(54) CONVECTION BASED COOKING APPARATUS WITH ADJUSTABLE INLET SHUTTER

(71) Applicant: Laxminarasimhan Vasan, Diamond Bar, CA (US)

(72) Inventor: Laxminarasimhan Vasan, Diamond Bar, CA (US)

( * ) Notice: Subject to any disclaimer, the term of this patent is extended or adjusted under 35 U.S.C. 154(b) by 166 days.

(21) Appl. No.: 14/938,787

(22) Filed: Nov. 11, 2015

(65) Prior Publication Data

US 2017/0130964 A1 May 11, 2017

(51) Int. Cl.

| | |
|---|---|
| ***F24C 3/00*** | (2006.01) |
| ***A47J 37/00*** | (2006.01) |
| ***F24C 3/12*** | (2006.01) |
| ***F24C 15/32*** | (2006.01) |

(52) U.S. Cl.

CPC ..... *F24C 3/124* (2013.01); *F24C 15/322* (2013.01)

(58) Field of Classification Search

CPC .... A47J 37/00; A47J 37/0623–37/0664; F24C 3/00; F24C 5/00

USPC ..... 99/467–482; 219/399–401; 126/21 A, 126/21 R

See application file for complete search history.

(56) References Cited

U.S. PATENT DOCUMENTS 3,422,809 A * 1/1969 Perry ..... F24C 14/025 126/21 A
3,423,568 A * 1/1969 Vonderhaar ..... C11D 3/0057 126/21 R
3,735,750 A * 5/1973 Detterbeck ..... F24C 3/128 126/197
4,928,663 A * 5/1990 Nevin ..... F24C 15/322 126/21 A
5,325,842 A * 7/1994 Beach ..... F24C 3/126 126/21 R
5,350,903 A * 9/1994 Takei ..... H05B 6/642 219/716
5,361,751 A * 11/1994 Biggs ..... F24H 6/00 126/101
5,460,158 A * 10/1995 Rigaud ..... F24C 15/327 126/20
5,639,497 A * 6/1997 Bedford ..... A47J 37/042 426/233
6,497,276 B2 * 12/2002 Clark ..... F25D 23/12 126/21 A
9,228,743 B2 * 1/2016 Cadima ..... F23D 14/10
(Continued)

*Primary Examiner* — Michael A Laflame, Jr.
(74) *Attorney, Agent, or Firm* — Kirk A. Buhler; Buhler & Associates Patenting

(57) ABSTRACT

A convection based cooking apparatus having enhanced heat retention. The convention based cooking apparatus includes a cooking chamber configured to holding food to be processed. An air inlet situated in fluid communication with the cooking chamber for receiving air into the cooking chamber. A heating source configured to switch between an ON state and an OFF state, whereby a temperature of air located within the cooking chamber is regulated. A drafting means that circulates air present within the cooking chamber. An inlet control apparatus that regulates air flow into the cooking chamber via the air inlet. The inlet control allows air to flow into the cooking chamber via the air inlet when the heating source is in the ON state. The inlet control prevents air from flowing into the cooking chamber via the air inlet when the heating source is OFF.

19 Claims, 5 Drawing Sheets

(56) References Cited

U.S. PATENT DOCUMENTS

| | | | | |
|---|---|---|---|---|
| 2002/0157659 | A1* | 10/2002 | Rummel | F23D 14/04 126/39 R |
| 2002/0170303 | A1* | 11/2002 | Clark | F25B 41/04 62/196.4 |
| 2003/0172919 | A1* | 9/2003 | Rabas | F24C 15/322 126/21 A |
| 2004/0107953 | A1* | 6/2004 | Hegge | A21B 1/26 126/21 A |
| 2006/0076005 | A1* | 4/2006 | Kim | F24C 3/067 126/214 R |
| 2012/0111316 | A1* | 5/2012 | Chezem | F24C 3/087 126/39 E |
| 2014/0137853 | A1* | 5/2014 | Murray | F24C 15/322 126/21 A |
| 2014/0144423 | A1* | 5/2014 | Wie | F24C 15/322 126/39 E |
| 2015/0075513 | A1* | 3/2015 | Paller | F24C 15/006 126/198 |
| 2016/0061456 | A1* | 3/2016 | Jang | F24C 5/04 126/49 |

* cited by examiner

CONVECTION BASED COOKING APPARATUS WITH ADJUSTABLE INLET SHUTTER

BACKGROUND OF THE INVENTION

1. Field of the Invention

This invention relates generally to ovens and more particularly to a convection based cooking apparatus having enhanced heat retention via an adjustable inlet shutter.

2. Description of the Related Art

Today, modern ovens are used throughout the world for heating, roasting, baking, and other food preparation purposes. Most conventional ovens typically use a gas burner or electrical heating element to heat air inside a thermally insulated chamber. The heated air then transfers heat to food product placed inside the chamber, resulting in the desired baking, roasting, or other desired cooking functionality.

Conventional ovens are generally of two types: a standard oven and a convection oven. Standard ovens utilize a gas burner or electrical heating element to heat air inside the thermally insulated chamber. The heated air is then exhausted from the chamber via gravity. In this manner, heat is transferred to food product located within the chamber.

To improve overall cooking efficiency and uniform heat transfer, convection ovens have been developed. Convection ovens circulate the heated air within the thermally insulated chamber to enhance overall cooking efficiency. More particularly, when using a gas burner as a heating element, a convection oven draws air into the oven via a vent and over the gas burner. The resulting products of combustion are then drawn into the thermally insulated chamber via a blower or fan, and circulated within the chamber. As more products of combustion are drawn into the cooking chamber, the pressure within the chamber increases. At a certain point, a portion of the hot air is released via an exhaust opening.

When the temperature in the oven chamber is satisfied, the gas burner turns off, while the blower continues to run and circulate the air within the chamber. However, as the blower continues to run, it draws in colder air via the vent into the oven chamber since the gas burner is off and no longer heating the drawn in air. This cooler air mixes with the hotter air and drops the temperature in the oven chamber from the dilution of the heat. However, the pressure is still present within the oven chamber resulting in air escaping from the exhaust. Once the temperature drops to a predefined level, the thermostat senses the drop and turns the gas burner back on, resulting in hot air being pulled back into the oven chamber.

Thus, convection ovens operate in cycles, turning on and off. That is, the oven heating elements are turned on to allow the heat within the oven chamber to increase to a predefined level. Then, once the predefined temperature is achieved, the heating elements are turned off, allowing the air within the oven chamber to cool until the temperature within the oven chamber drops below the predefined level, at which point the heating elements are turned on again. This cycle continues as the food product is cooked to maintain the oven temperature at approximately the desired cooking temperature. Unfortunately, the cooling of the oven temperature as a result of a combination of the heating elements being turned off and the chamber air being exhausted, causes undesirable energy consumption as the heating elements are frequently cycled on to increase the oven chamber temperature back to the desired level.

In view of the forgoing, there is a need for an oven capable of reducing the amount of cycling required to maintain desired cooking temperatures within the oven chamber. The oven should be capable of maintaining heat levels within the oven chamber for increased time periods. In addition, the oven should be capable of achieving these increased heat maintenance levels for gas burner based heating elements, as well as when utilizing combi oven configurations.

SUMMARY OF THE INVENTION

Broadly speaking, embodiments of the present invention address these needs by providing a convection based cooking apparatus having enhanced heat retention. In one embodiment, the convention based cooking apparatus includes a cooking chamber configured to holding food to be processed. An air inlet is situated in fluid communication with the cooking chamber for receiving air into the cooking chamber. In addition, a heating source is included that is configured to switch between an ON state and an OFF state, whereby a temperature of air located within the cooking chamber is regulated. Further, a drafting means is provided that is configured to circulate air present within the cooking chamber. In one aspect, the heating source can comprise at least one gas burner, and the drafting means can be a blower. Also included is an inlet control apparatus that regulates air flow into the cooking chamber via the air inlet. The inlet control apparatus allows air to flow into the cooking chamber via the air inlet when the heating source is in the ON state. In addition, the inlet control apparatus prevents air from flowing into the cooking chamber via the air inlet when the heating source is in the OFF state. In one aspect, the inlet control apparatus can comprise a shutter in communication with a linear solenoid. In this aspect, the shutter can prevent air from flowing into the cooking chamber via the air inlet when the heating source is in the OFF state, and allow air to flow into the cooking chamber via the air inlet when the heating source is in the ON state.

In additional embodiment, a method is disclosed for providing enhanced heat retention in a convection based cooking apparatus. The method includes setting a heating source to an ON state and allowing air to flow into a cooking chamber via an air inlet. Next, a determination is made as to whether the temperature within the cooking chamber has reached a predetermined level. Then, when the temperature within the cooking chamber has reached the desired level, the heating source is set to an OFF state and air is prevented from flowing into the cooking chamber via the air inlet. During this process the air present within the cooking chamber is circulated. Similar to above, the drafting means can be a blower and the heating source can comprises at least one gas burner. An inlet control apparatus prevents air from flowing into the cooking chamber when the heating source is in the OFF state, and allows air to flow into the cooking chamber when the heating source is in the ON state.

A further convection based cooking apparatus having enhanced heat retention is disclosed in an additional embodiment of the present invention. In this embodiment, a cooking chamber is included that is configured to holding food to be processed. In addition, an air inlet is in fluid communication with the cooking chamber for receiving air into the cooking chamber. Also, at least one gas burner is included that is configured to switch between an ON state that provides heat and an OFF state that does not provide heat, whereby a temperature of air located within the cooking chamber is regulated. Further, a drafting means is provided that is configured to circulate air present within the cooking chamber. Similar to above, an inlet control apparatus is included that is configured to regulate air flow into the cooking chamber via the air inlet. The inlet control apparatus allows air to flow into the cooking chamber via the air inlet when the gas burner is in the ON state, and prevents air from flowing into the cooking chamber via the air inlet when the gas burner is in the OFF state. In this aspect, the drafting means can be a blower. As above, the inlet control apparatus can comprise a shutter in communication with a linear solenoid. In this aspect, the shutter prevents air from flowing into the cooking chamber when the gas burner is in the OFF state, and allows air to flow into the cooking chamber when the gas burner is in the ON state.

In this manner, embodiments of the present invention provide enhanced heat retention in the cooking chamber, allowing the heating source to remain cycled OFF for longer periods of time. This provides significant energy savings, both in terms of lower gas usage for the gas burner elements and in terms of overall heat output from the oven, resulting in lower kitchen air-conditioning requirements. Moreover, because of the reduced need for cycling the heating source, embodiments of the present invention provide increased cooking efficiency, and better finished food products, as well as increased production capability. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a convection based cooking apparatus having enhanced heat retention using an adjustable inlet shutter. In general, embodiments of the present invention prevent the introduction of outside air into the oven cooking chamber when the heating elements are off and allow the introduction of cool outside air into the oven cooking chamber when the heating elements are on. By preventing the introduction of outside air into the oven cooking chamber when the heating elements are off, embodiments of the present invention maintain heat levels within the oven cooking chamber at desired levels much longer than is possible using conventional convection ovens.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
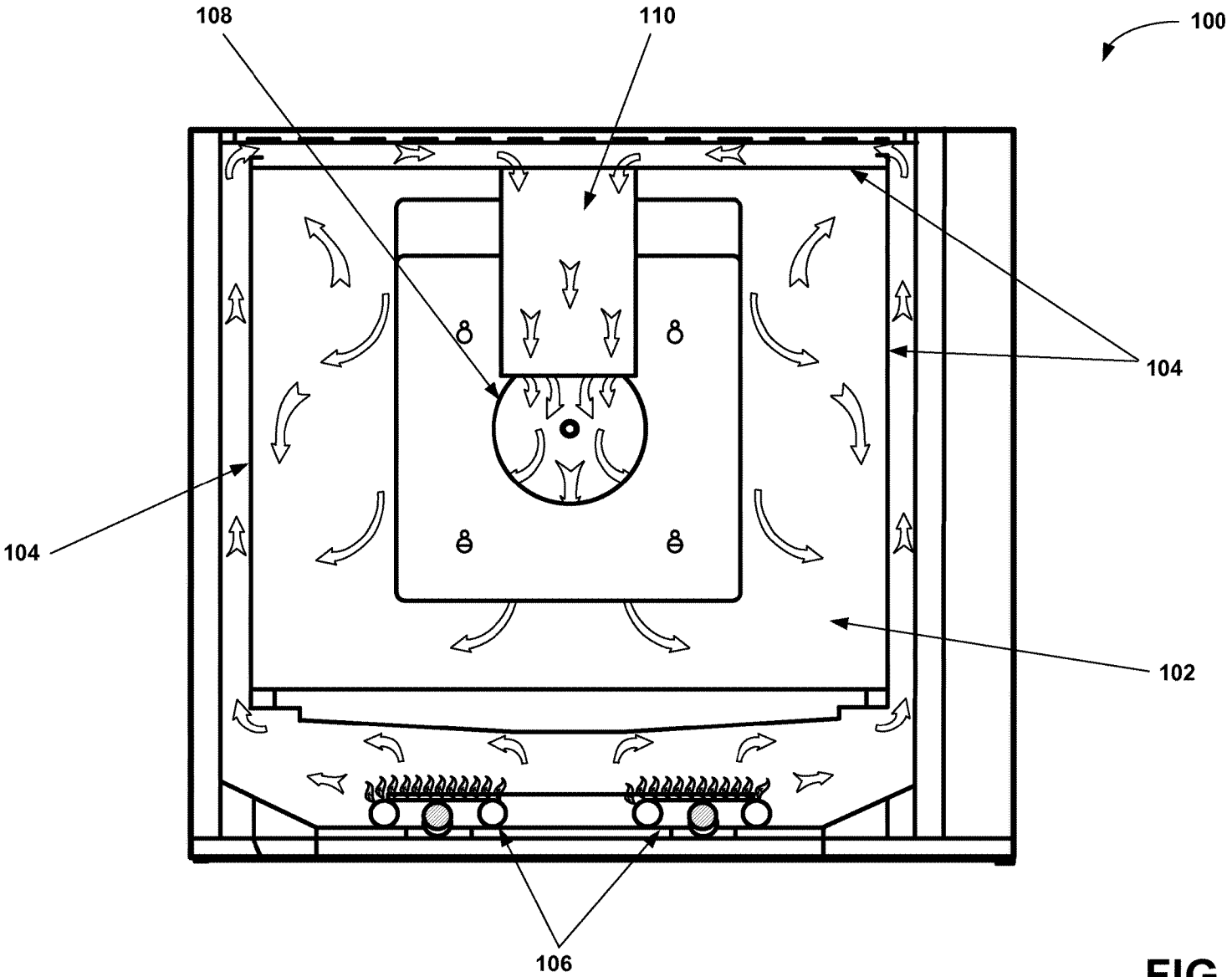
FIG. 1 is an illustration showing front view of an exemplary convection based cooking apparatus utilizing gas burner heating elements and having enhanced heat retention, in accordance with an embodiment of the present invention.

FIG. 1 is an illustration showing a front view of an exemplary convection based cooking apparatus 100 utilizing gas burner heating elements and having enhanced heat retention, in accordance with an embodiment of the present invention. The convection based cooking apparatus 100 includes a cooking chamber 102 defined by a plurality of sidewalls 104. A heating source 106 is disposed below the cooking chamber 102. In the example of FIG. 1 the heating source 106 is gas burner heating elements, which can switch between an ON state and an OFF state to regulate the temperature of air located within the cooking chamber 102.

In addition, a drafting means, such a blower 108 is disposed in a back wall of the cooking chamber 102. Although the blower 108 is shown as being disposed in a back wall of the cooking chamber 102, it should be noted that the blower 108 can be situated in any area from which it can operate as a drafting and/or circulating mechanism. As will be discussed in greater detail subsequently, the drafting means is configured to circulate air present within the cooking chamber 102 to provide enhancing cooking functionality. Situated near the blower 108 is a snorkel 110, which operates to provide air to the cooking chamber 102 via an air inlet, as illustrated in FIG. 2A.

Figure 2A:
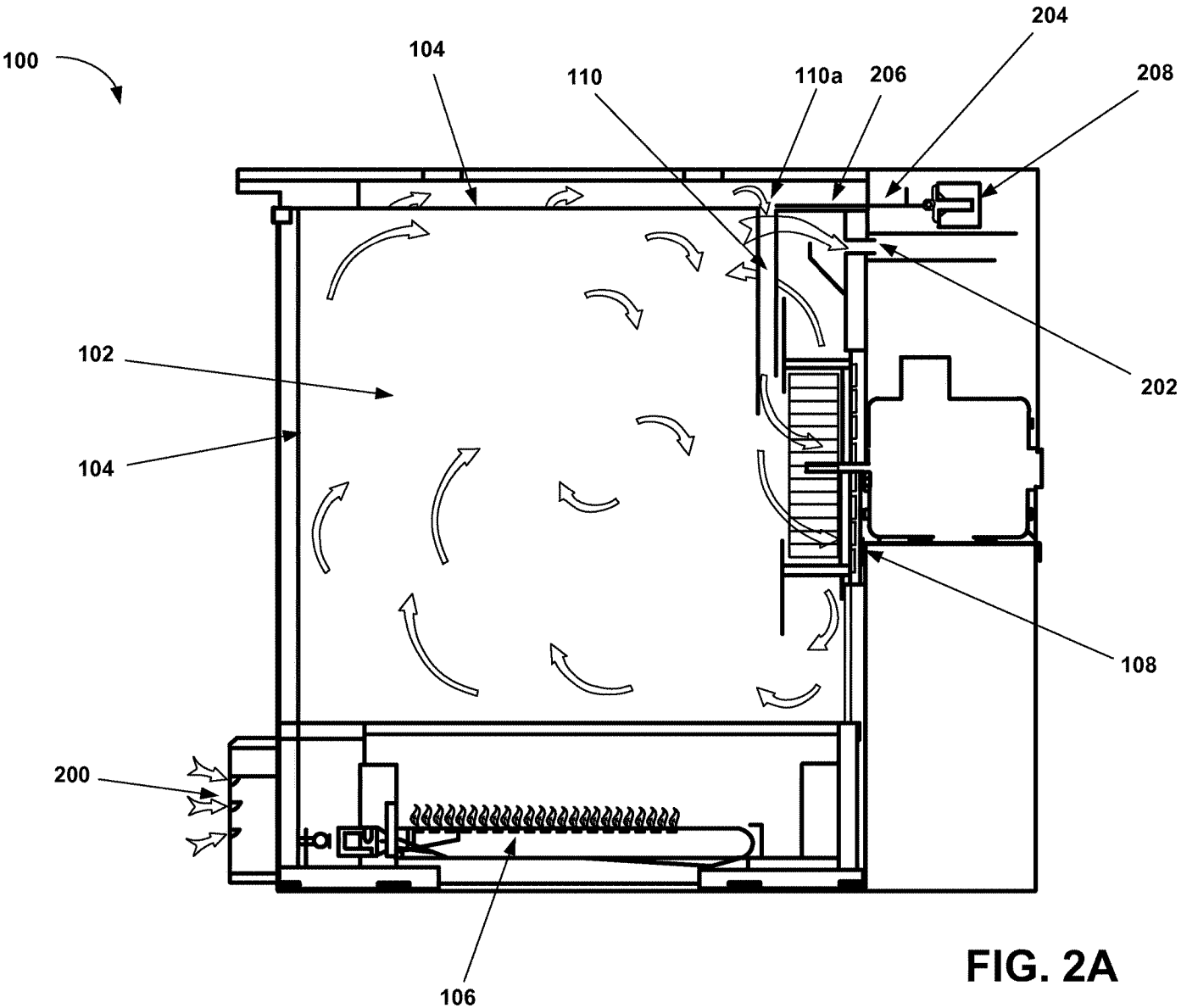
FIG. 2A is an illustration showing a side view of an exemplary convection based cooking apparatus having enhanced heat retention when the gas burning heating elements are in an ON state, in accordance with an embodiment of the present invention.

FIG. 2A is an illustration showing a side view of an exemplary convection based cooking apparatus 100 when the gas burner heating elements are in an ON state, in accordance with an embodiment of the present invention. In operation, the blower 108 draws in air, via the air inlet 200, across the heating source 106 (i.e., the gas burner heating elements), which heats the air. The resulting products of combustion are then drawn around the side walls 104 and into the cooking chamber 102 via the snorkel 110, as illustrated in FIG. 1. It should be noted that in the present disclosure, the term air inlet 200 is defined as an opening or other means that allows air to flow into the oven, across the heating source 106, and into the cooking chamber 102. The air outlet 202, on the other hand, is defined as an opening or other means that allows air to flow out of the oven cooking chamber 102, without crossing the heating source 106.

Turning back to FIG. 2A, the blower 108 continues to circulate the air present in the cooking chamber 102 to facilitate cooking the food product. As more products of combustion are drawn into the cooking chamber 102, the pressure within the cooking chamber 102 increases. The pressure is alleviated by allowing the hot air to escape the cooking chamber 102 via an air outlet 202. To enhance heat retention, embodiments of the present invention include an inlet control apparatus 204 that includes an adjustable inlet shutter 206. An inlet control apparatus 204 is defined in the present application to mean a mechanism that allows air to flow into the cooking chamber 102 via the air inlet 200 when the heating source 106 (i.e., gas burners) is in the ON state, and prevents air flow into the cooking chamber 102 via the air inlet 200 when the heating source 106 is in the OFF state, and not providing heat to the cooking chamber 102. At least a portion of the inlet control apparatus 204 is disposed between the air inlet 200 and the cooking chamber 102 when the heating source 106 is in the OFF state, thus prevents air flow into the cooking chamber 102 when the heating source 106 is in the OFF state. In one embodiment, at least a portion of the inlet control apparatus 204 is disposed in front of the air inlet 200 when the heating source 106 is in the OFF state, thus prevents air flow into the cooking chamber 102 when the heating source 106 is in the OFF state. In a further embodiment, at least a portion of the inlet control apparatus 204 is disposed just inside the cooking chamber 102 and covering the interface between the air inlet and the cooking chamber 102 when the heating source 106 is in the OFF state, thus prevents air flow into the cooking chamber 102 when the heating source 106 is in the OFF state.

It should be borne in mind that the inlet control apparatus 204 is not associated with or used in conjunction with the air outlet 202.

For example, the adjustable inlet shutter 206 portion of the inlet control apparatus 204 of the embodiments of the present invention is configured to allow air to flow into the cooking chamber 102 via the air inlet 200 when the heating source 106 (i.e., gas burners) is in the ON state, providing heat to the cooking chamber 102. However, when the heating source 106 is in the OFF state, and not providing heat to the cooking chamber 102, the adjustable inlet shutter 206 is positioned between the air inlet 200 and the cooking chamber 102 to prevent air flow into the cooking chamber 102 via the air inlet 200. In one embodiment, the adjustable inlet shutter 206 blocks the snorkel inlet portion 110*a* of the snorkel 110 when the heating source 106 is in the OFF state, thus blocking air flow from the air inlet 200 into the cooking chamber 102. However, it should be noted that the inlet control apparatus 204 of the embodiments of the present invention can be located in any position that allows the inlet control apparatus 204 to prevent air flow into the cooking chamber 102 via the air inlet when the heating apparatus in the OFF state. For example, the inlet control apparatus 204 can be located outside and in front of the air inlet 200. Alternatively, the inlet control apparatus 204 can be located just inside the air inlet 200, either before or after the heating source 106.

Figure 2B:
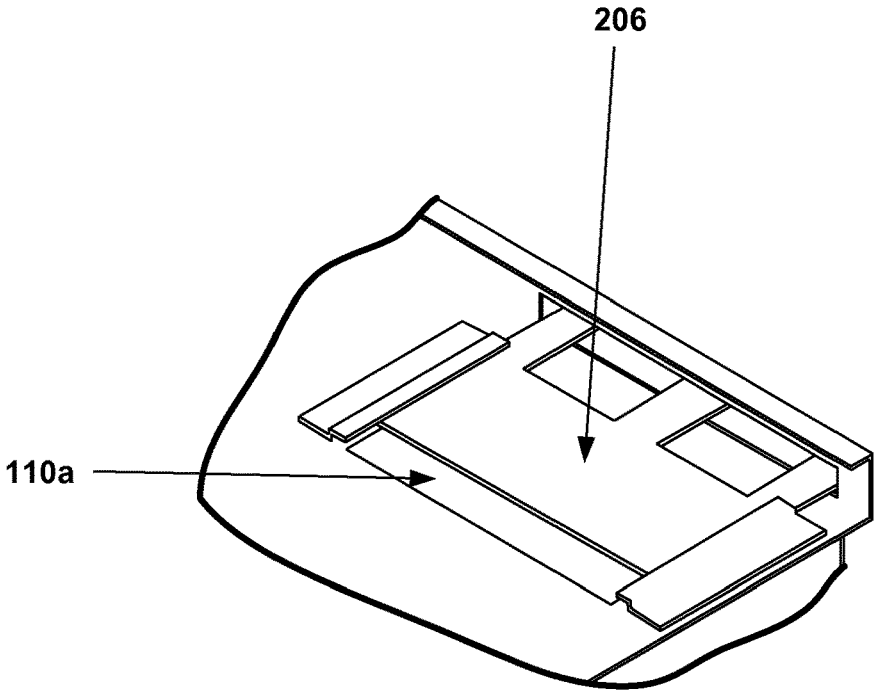
FIG. 2B is an illustration showing an isometric top view of an adjustable inlet shutter in an open position when the gas burner heating elements are in an ON state, in accordance with an embodiment of the present invention.

In one embodiment, the inlet control apparatus 204 comprises an adjustable inlet shutter 206 coupled to a linear solenoid 208. For example, the linear solenoid can be an electrical coil wound around a cylindrical tube with a ferro-magnetic actuator that is free to move in and out of the coils body. FIG. 2B is an illustration showing an isometric top view of an adjustable inlet shutter 206 in an open position when the gas burner heating elements are in an ON state, in accordance with an embodiment of the present invention. The linear solenoid 208 can be actuated to control when the adjustable inlet shutter 206 closes the interface (i.e., the snorkel inlet portion 110*a*) between the air inlet 200 and the snorkel 110, thus preventing outside air from flowing into the cooking chamber 102. Similarly, the linear solenoid 208 can be actuated to control when the adjustable inlet shutter 206 opens the interface between the air inlet 200 and the snorkel 110, thus allowing outside air into the cooking chamber 102. Although FIG. 2A illustrates the usage of a linear solenoid as an element of the inlet control apparatus 204, it should be noted that any apparatus, for example a rotary solenoid, capable of operating the adjustable inlet shutter 206 and/or blocking or allowing outside air to flow from the air inlet 200 into the cooking chamber 102 can be utilized in the embodiments of the present invention as an inlet control apparatus 204 or part thereof.

Figure 3B:
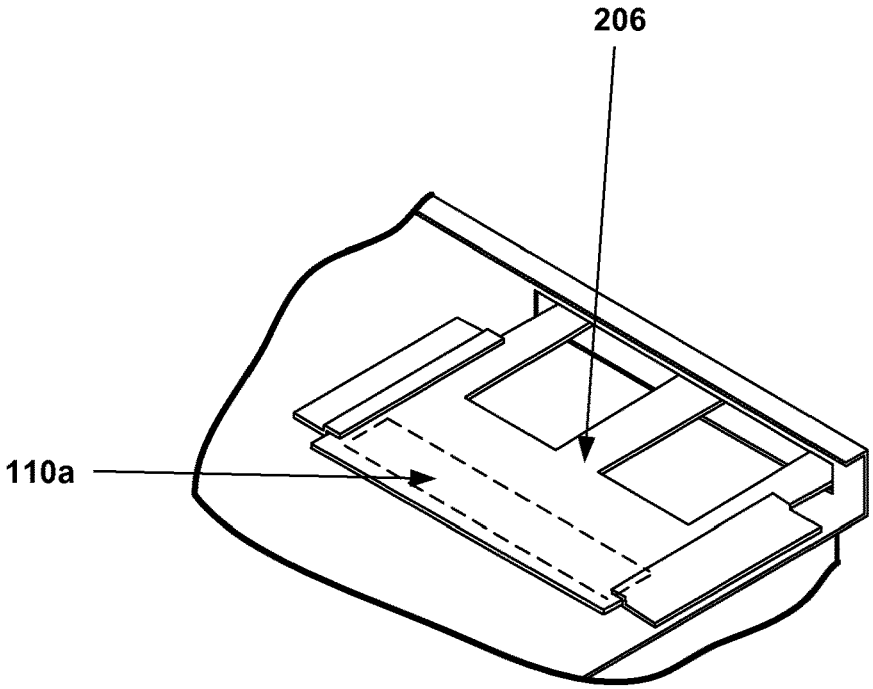
FIG. 3B is an illustration showing an isometric top view of an adjustable inlet shutter in a closed position when the gas burner heating elements are in an OFF state, in accordance with an embodiment of the present invention.
Figure 3A:
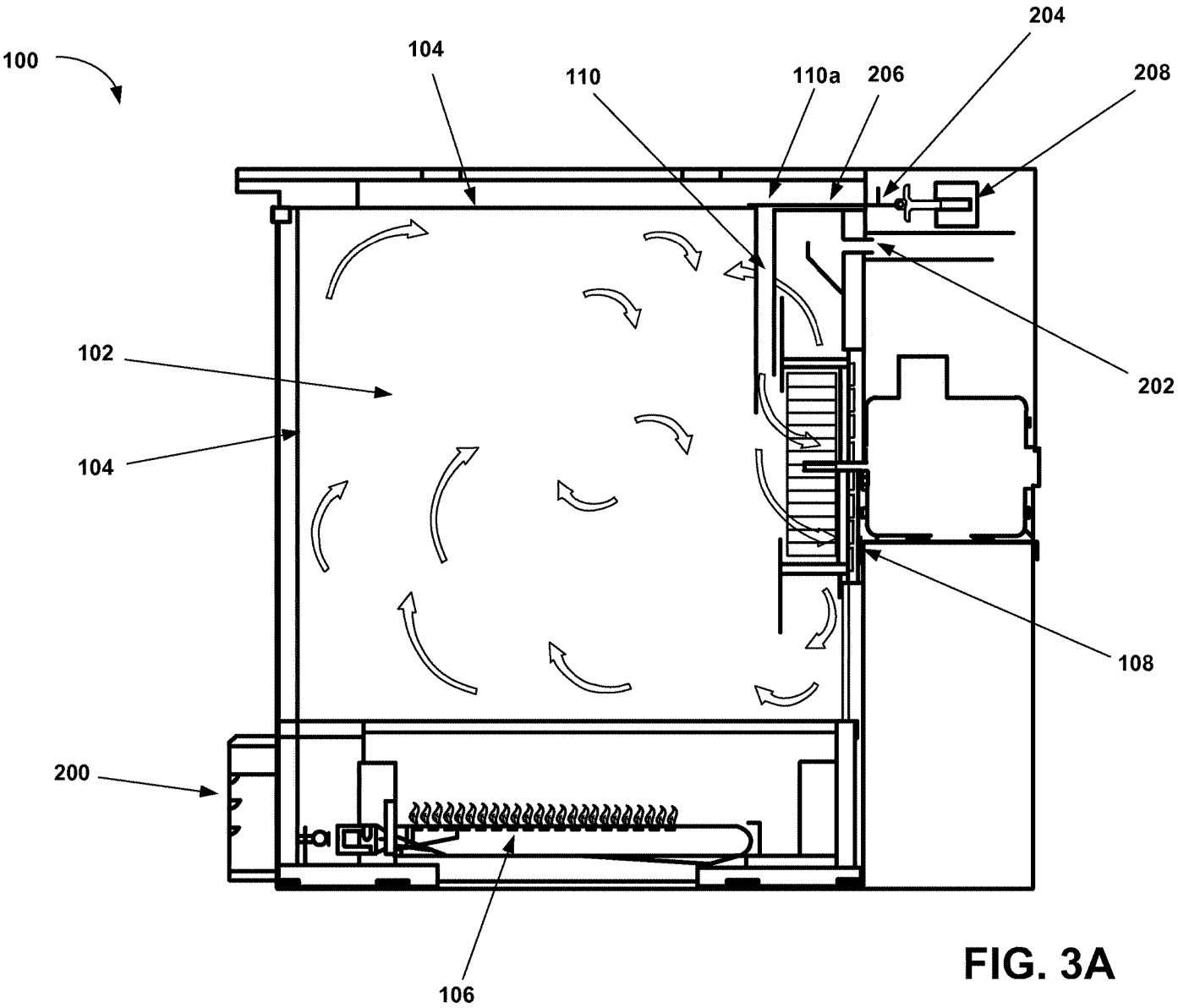
FIG. 3A is an illustration showing a side view of an exemplary convection based cooking apparatus having enhanced heat retention when the gas burning heating elements are in an OFF state, in accordance with an embodiment of the present invention.

FIG. 3A is an illustration showing a side view of an exemplary convection based cooking apparatus 100 having enhanced heat retention when the gas burning heating elements are in an OFF state, in accordance with an embodiment of the present invention. When the gas burner heating elements 106 are in the OFF state, the blower 108 continues to circulate the air within the cooking chamber 102. However, as described previously, when the heating source 106 is in the OFF state, and not providing heat to the cooking chamber 102, the inlet control apparatus 204 prevents outside air from entering the cooking chamber 102 via the air inlet 200. For example, in FIG. 3A the adjustable inlet shutter 206 is pushed forward via the linear solenoid 208, which closes the interface 110*a* between the air inlet 200 and the snorkel 110. This is also illustrated in FIG. 3B, which shows an isometric top view of an adjustable inlet shutter 206 in a closed position when the gas burner heating elements are in an OFF state, in accordance with an embodiment of the present invention. As a result, outside air is prevented from flowing into the cooking chamber 102. Moreover, the pressure within the cooking chamber 102 enhances the seal between the adjustable inlet shutter 206 and the interface 110*a* of the snorkel 110, thus substantially reducing air leakage.

As can be appreciated, in order for air to escape the cooking chamber 102 via the air outlet 202, air flow must come from the air inlet 200 via the snorkel 110. Thus, closing the interface 110*a* between the air inlet 200 and the snorkel 110 also substantially restricts air from escaping the cooking chamber via the air outlet 202. Hence, embodiments of the present invention eliminate heat dilution caused by cooler air being drawn into the cooking chamber 102 via the air inlet 200 when the heating source 106 is in the OFF state. In this manner, embodiments of the present invention provide enhanced heat retention in the cooking chamber 102, allowing the heating source 106 to remain cycled OFF for longer periods of time. This provides significant energy savings, both in terms of lower gas usage for the gas burner elements and in terms of overall heat output from the oven, resulting in lower kitchen air-conditioning requirements. Moreover, because of the reduced need for cycling the heating source, embodiments of the present invention provide increased cooking efficiency, and better finished food products, as well as increased production capability.

Eventually, the temperature of the air present within the cooking chamber 102 may fall below a desired level, at which point the heating source 106 is set back to the ON state. In addition to setting the heating source 106 back to the ON state, embodiments of the present invention also open the interface 110*a* between the air inlet 200 and the snorkel 110, thus allowing air to enter the cooking chamber 102. Opening the interface 110*a* between the air inlet 200 and the snorkel 110 also allows air to vent and escape from the cooking chamber 102 as the pressure within the cooking chamber 102 rises due to the rising temperature within the chamber. This cycling process is further illustrated next with reference to FIG. 4.

Figure 4:
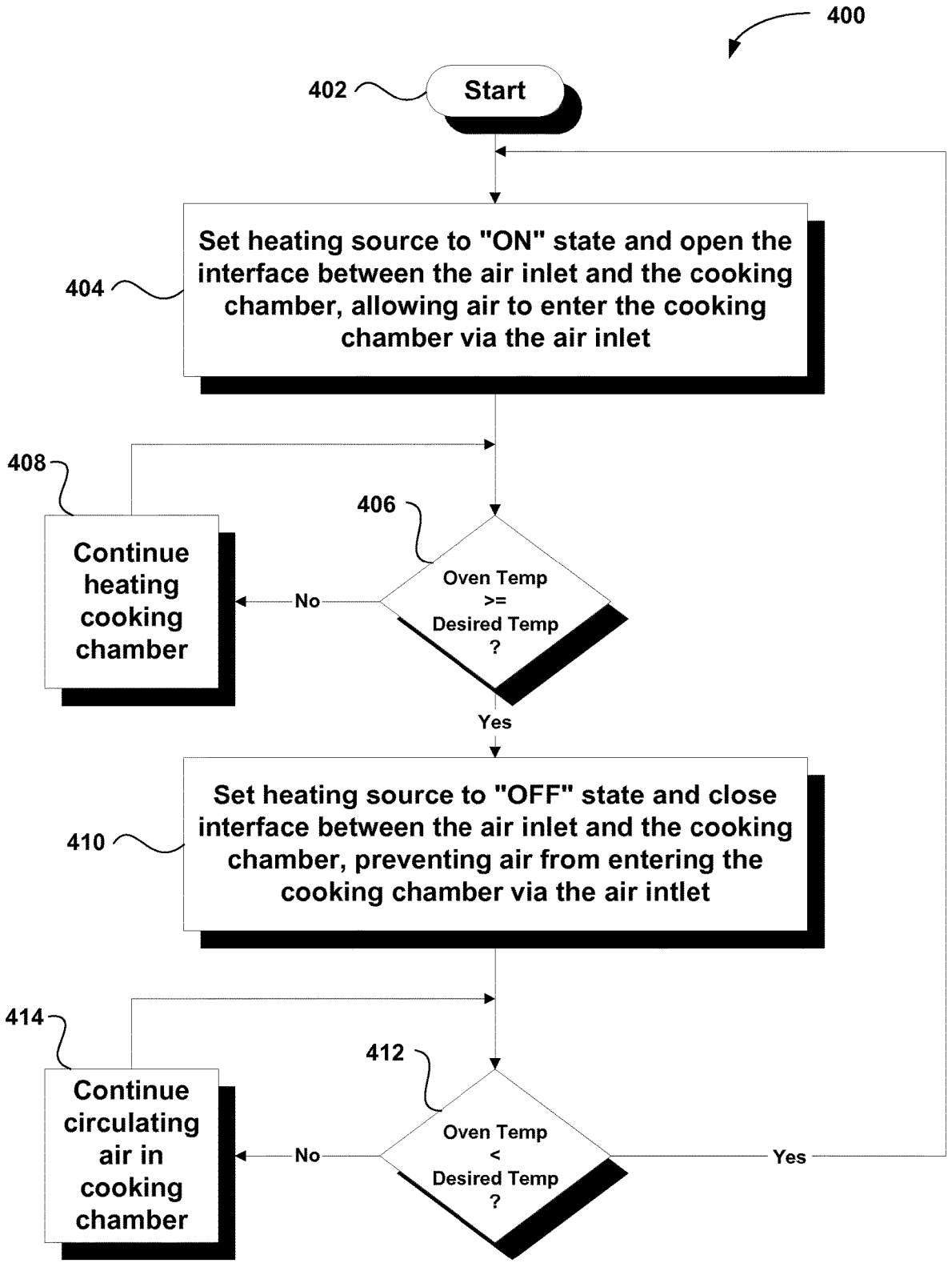
FIG. 4 is a flowchart showing a method for providing enhanced heat retention in a convection based cooking apparatus, in accordance with an embodiment of the present invention.

FIG. 4 is a flowchart showing a method 400 for providing enhanced heat retention in a convection based cooking apparatus, in accordance with an embodiment of the present invention. In an initial operation 402, preprocess operations are performed. Preprocess operations can include, for example, setting a thermostat to a desired temperature, placing food product within the cooking chamber of the oven, and other preprocess operations that will be apparent to those skilled in the art in view of the hindsight provided by a careful examination of the present disclosure.

In a heating operation 404, the heating source is set to an ON state that provides heat and the interface between the air inlet and the cooking chamber is opened, allowing outside air to flow into the cooking chamber via the air inlet. For example, during operation, the blower draws in air via the air inlet and across the heating source, which heats the air. The resulting products of combustion are then drawn around the side walls and into the cooking chamber via the snorkel. The blower also circulates the air present in the cooking chamber to facilitate cooking the food product. As more products of combustion are drawn into the cooking chamber, the pressure within the cooking chamber increases. The pressure is alleviated by the air outlet, which allows the hot air to escape the cooking chamber when the heating source is set to the ON state.

A decision is then made as to whether the temperature within the cooking chamber is equal to or greater than a desired cooking temperature, in operation 406. If the temperature within the cooking chamber is equal to or greater than the desired cooking temperature, the method continues to an OFF cycle operation 410. Otherwise, the method branches to operation 408.

In operation 408, the heating source continues to heat the air drawn into the cooking chamber. For example, in one embodiment a thermostat is used to set and detect a desired temperature within the cooking chamber of the oven. When the thermostat determines that the temperature in the cooking chamber has not yet reached the desired temperature, the heating source continues to provide heat to the oven. However, when the thermostat determines that the temperature in the cooking chamber has reached the desired temperature, the heating source cycles to an OFF state in operation 410.

In operation 410, the heating source is set to an OFF state and the interface between the air inlet and the cooking chamber is closed, preventing outside air to flow into the cooking chamber via the air inlet. When the gas burner heating elements are in the OFF state, the blower continues to circulate the air within the cooking chamber. However, the inlet control apparatus prevents outside air from entering the cooking chamber via the air inlet when the heating source is set to the OFF state and no longer provides heat.

A decision is then made as to whether the temperature within the cooking chamber is less than the desired cooking temperature, in operation 412. If the temperature within the cooking chamber is equal to or greater than a desired cooking temperature, the method branches to circulation operation 414. Otherwise, the method returns to heating operation 404.

In circulation operation 414, the blower continues to circulate the air present in cooking chamber. For example, when the thermostat determines that the temperature in the cooking chamber has reached the desired temperature, the heat source is set to the OFF state, the interface between the air inlet and the cooking chamber is closed, and the blower continues to circulate the air present in the cooking chamber. As described previously, closing the interface between the air inlet and the cooking chamber prevents air from being drawn into the cooking chamber and thus reduces or eliminates heat dilution caused by cooler air being drawn into the cooking chamber when the heating source is in the OFF state. Also, closing the interface between the air inlet and the cooking chamber also substantially restricts air from escaping the cooking chamber via the air outlet. Eventually, the temperature of the air present within the cooking chamber may fall below a desired level. At that point the heating source is set back to the ON state and the interface between the air inlet and the cooking chamber is opened again, thus allowing air to flow into the cooking chamber and escape from the cooking chamber via the air outlet as the pressure rises due to the rising temperature, in heating operation 404.

In this manner, embodiments of the present invention provide enhanced heat retention in the cooking chamber, allowing the heating source to remain cycled OFF for longer periods of time. This provides significant energy savings, both in terms of lower gas usage for the gas burner elements and in terms of overall heat output from the oven, resulting in lower kitchen air-conditioning requirements.

It should be noted that the described embodiments of the present invention also apply to combi ovens. A combi oven combines the abilities of a convection oven and a steam cooker, thus allowing the user to regulate the humidity within the cooking chamber as well as the temperature. In such embodiments, similar to above, the cooking chamber is allowed to enter the cooking chamber via the air inlet when the heating source is in the ON state, heating the air within the cooking chamber. When the heating source is cycled to the OFF state, the inlet control apparatus prevents outside air from entering the cooking chamber via the air inlet.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A convection based cooking apparatus having enhanced heat retention, comprising:

a cooking chamber for holding food to be processed;

an air inlet in fluid communication through a snorkel into the cooking chamber for receiving air into the cooking chamber;

at least one gas burner heating source having an ON state that provides heat and an OFF state that does not provide heat, whereby a temperature of air located within the cooking chamber is regulated;

a blower drafting means that circulates air present within the cooking chamber; and an inlet control shutter at the entrance of the snorkel that regulates air flow through the snorkel into the cooking chamber via the air inlet, wherein the inlet control shutter allows air into the cooking chamber via the air inlet when the heating source is in the ON state, and wherein the inlet control shutter prevents air from flowing into the cooking chamber via the air inlet when the heating source is in the OFF state.

2. The convection based cooking apparatus as recited in claim 1, wherein the inlet control shutter is in communication with a linear solenoid.

3. The convection based cooking apparatus as recited in claim 2, wherein the shutter is configured to prevent air from flowing into the cooking chamber via the air inlet when the heating source is in the OFF state.

4. The convection based cooking apparatus as recited in claim 2, wherein the shutter allows air to flow into the cooking chamber via the air inlet when the heating source is in the ON state.

5. A convection based cooking apparatus having enhanced heat retention, comprising:

a cooking chamber for holding food to be processed;

an air inlet in fluid communication through a snorkel into the cooking chamber for receiving air into the cooking chamber;

at least one gas burner having an ON state that provides heat and an OFF state that does not provide heat, whereby a temperature of air located within the cooking chamber is regulated;

a blower drafting means circulates air present within the cooking chamber; and an inlet control shutter at the entrance of the snorkel that regulates air flow through the snorkel into the cooking chamber via the air inlet, wherein the inlet control shutter allows air into the cooking chamber via the air inlet when the gas burner is in the ON state, and wherein the inlet control shutter prevents air from flowing into the cooking chamber via the air inlet when the gas burner is in the OFF state.

6. The convection based cooking apparatus as recited in claim 5, wherein the inlet control shutter is in communication with a linear solenoid.

7. The convection based cooking apparatus as recited in claim 5, wherein the shutter is disposed between the air inlet and the cooking chamber when the gas burner is in the OFF state.

8. The convection based cooking apparatus as recited in claim 6, wherein the shutter prevents air from flowing into the cooking chamber via the air inlet when the gas burner is in the OFF state.

9. The convection based cooking apparatus as recited in claim 7, wherein the shutter allows air to flow into the cooking chamber via the air inlet when the gas burner is in the ON state.

10. The convection based cooking apparatus as recited in claim 1, wherein there is a seal between the inlet control shutter and the snorkel.

11. The convection based cooking apparatus as recited in claim 10, wherein a pressure within the cooking chamber enhances a seal between outside of the cooking chamber and the cooking chamber.

12. The convection based cooking apparatus as recited in claim 1, wherein an inlet control shutter blocks airflow into the snorkel.

13. The convection based cooking apparatus as recited in claim 1, wherein an inlet control shutter blocks airflow into the snorkel when the heating source is in the OFF state.

14. The convection based cooking apparatus as recited in claim 1, wherein the inlet air through the snorkel is drafted directly into the blower.

15. The convection based cooking apparatus as recited in claim 5, wherein there is a seal between the inlet control shutter and the snorkel.

16. The convection based cooking apparatus as recited in claim 15, wherein a pressure within the cooking chamber enhances a seal between outside of the cooking chamber and the cooking chamber.

17. The convection based cooking apparatus as recited in claim 5, wherein an inlet control shutter blocks airflow into the snorkel.

18. The convection based cooking apparatus as recited in claim 5, wherein an inlet control shutter blocks airflow into the snorkel when the heating source is in the OFF state.

19. The convection based cooking apparatus as recited in claim 5, wherein the inlet air through the snorkel is drafted directly into the blower.

* * * * *